US008299713B2

(12) United States Patent
Hooker et al.

(10) Patent No.: US 8,299,713 B2
(45) Date of Patent: Oct. 30, 2012

(54) CHARGED PARTICLE ACCELERATOR AND RADIATION SOURCE

(75) Inventors: Simon Martin Hooker, Oxford (GB); Anthony Joseph Gonsalves, Oxford (GB); Dino Anthony Jaroszynski, Glasgow (GB); Wim Pieter Leemans, Berkeley, CA (US)

(73) Assignee: Isis Innovation Limited, Oxford (GB)

( * ) Notice: Subject to any disclaimer, the term of this patent is extended or adjusted under 35 U.S.C. 154(b) by 659 days.

(21) Appl. No.: 12/440,799

(22) PCT Filed: Sep. 11, 2007

(86) PCT No.: PCT/GB2007/003435

§ 371 (c)(1),
(2), (4) Date: Nov. 10, 2009

(87) PCT Pub. No.: WO2008/032050

PCT Pub. Date: Mar. 20, 2008

(65) Prior Publication Data

US 2011/0199000 A1 Aug. 18, 2011

(30) Foreign Application Priority Data

Sep. 12, 2006 (GB) ..... 0617943.6

(51) Int. Cl.
*H05B 31/26* (2006.01)
*H05H 1/54* (2006.01)
*G21K 5/00* (2006.01)

(52) U.S. Cl. ..... 315/111.21; 315/111.61; 315/111.71; 315/505; 315/507; 313/359.1; 313/362.1; 250/395; 250/492.3

(58) Field of Classification Search ..... 315/111.21–111.91, 501–507; 313/359.1, 362.1, 221.01; 250/336.1, 395, 492.3
See application file for complete search history.

(56) References Cited

U.S. PATENT DOCUMENTS 4,937,532 A * 6/1990 Dawson et al. ..... 359/342
4,998,073 A * 3/1991 Miyata et al. ..... 315/500
5,637,962 A 6/1997 Prono et al.
5,789,876 A 8/1998 Umstadter et al.

(Continued)

FOREIGN PATENT DOCUMENTS

JP 2001-118696 4/2001

OTHER PUBLICATIONS

International Search Report for PCT/GB2007/003435, mailed Dec. 27, 2007.

(Continued)

*Primary Examiner* — Vibol Tan
(74) *Attorney, Agent, or Firm* — Nixon & Vanderhye P.C.

(57) ABSTRACT

A method of accelerating charged particles using a laser pulse fired through a plasma channel contained in a capillary, wherein the plasma waveguide has deviations along its length that cause deviations in the plasma density contained therein, the deviations in plasma density acting to promote charged particle injection into a wake of a passing laser pulse. A radiation source based on a laser-driven plasma accelerator in a plasma waveguide in which the plasma waveguide and/or laser injection process is/are controlled so as to produce an undulating path for the laser pulse through the waveguide, the undulation exerting a periodic transverse force on charged particles being accelerated in the wake of the laser pulse, the resulting charged particle motion causing controlled emission of high frequency radiation pulses.

20 Claims, 7 Drawing Sheets

U.S. PATENT DOCUMENTS

| | | | | |
|---|---|---|---|---|
| 5,986,415 | A * | 11/1999 | Nishihara | 315/505 |
| 6,657,391 | B2 * | 12/2003 | Ding et al. | 315/5.41 |
| 6,912,238 | B2 * | 6/2005 | Howard | 372/69 |
| 7,030,398 | B2 * | 4/2006 | Tajima | 250/505.1 |
| 7,239,686 | B2 * | 7/2007 | Berglund et al. | 378/119 |
| 2004/0195951 | A1 | 10/2004 | Suk et al. | |

OTHER PUBLICATIONS

Written Opinion of the International Searching Authority for PCT/GB2007/003435, mailed Dec. 27, 2007.

Uk Search Report for GB Application No. 0617943.6, dated Jan. 25, 2007.

Geddes, C.G.R. et al., "High-Quality Electron Beams from a Laser Wakefield Accelerator Using Plasma-Channel Guiding", Nature, vol. 431, No. 7008, (Sep. 30, 2004), pp. 538-541.

Spence, D. J. et al., "Application of the Gas-Filled Capillary Discharge Waveguide to Laser-Plasma Acceleration", AIP Conference Proceedings, No. 737, (2004), pp. 825-831.

* cited by examiner

CHARGED PARTICLE ACCELERATOR AND RADIATION SOURCE

This application is the U.S. national phase of International Application No. PCT/GB2007/003435, filed 11 Sep. 2007, which designated the U.S. and claims priority to Great Britain Application No. 0617943.6, filed 12 Sep. 2006, the entire contents of each of which are hereby incorporated by reference.

The present invention relates to a method and apparatus for accelerating charged particles and a method and apparatus for producing electromagnetic radiation using accelerated charged particles.

It has been known for some 25 years that the huge electric fields formed in the charge density wave that trails an intense laser pulse propagating through a plasma (ionized gas) could be used to accelerate charged particles in a distance which is one-thousand times smaller than that required with a conventional accelerator for comparable output energies. Laser-driven plasma accelerators, also known as wake-field accelerators, could therefore form the basis of a new class of very compact accelerator with dimensions of only a few centimeters (excluding the driving laser), and able to generate particle beams with energies equal to those delivered by conventional machines some tens or hundreds of meters long. A further advantage is that the output beam, usually electrons but other charged particles are also possible, from a plasma accelerator is comprised of pulses of much shorter duration (femtoseconds) than possible with a conventional accelerator (which typically delivers bunches several picoseconds long). Laser-driven plasma accelerators could therefore replace the conventional accelerators used to power radiation sources, such as synchrotrons, to form a compact source of short pulses of charged particles and tunable radiation.

However, there are practical difficulties associated with injecting charged particle bunches to be accelerated into the plasma accelerator, which can limit the quality of the accelerator output. For example, where bunches of charged particles are generated separately and transported to the plasma accelerator, it is very difficult to avoid the bunches becoming less well defined spatially (i.e. spreading out) during the transport phase. This and other limitations in the precision with which the injection process can be carried out can cause fluctuations in the output energy of the accelerator ("jitter") and/or undesirable energy spread within the output charged particle bunches.

Undulators may be used to derive electromagnetic radiation from accelerated charged particle beams and thereby form a radiation source. Such undulators are based on arrays of permanent magnets arranged so that their magnetic fields periodically deflect a charged particle beam passing through them. The transverse motion thus imparted to the charged particle beam produces so-called undulator or wiggler synchrotron radiation, which forms the basis of modern synchrotron sources. Undulators are also used in free-electron laser x-ray sources to produce intense coherent x-ray radiation. X-ray free-electron laser undulators are usually between 20 and 150 meters long and have many thousands of periods.

Generally, strong magnetic fields are required to deflect the charged particle beam, which makes it difficult to miniaturize the permanent magnets and produce a compact undulator.

It is an object of the present invention to provide an improved compact undulator for a radiation source. It is a further object of the invention to improve charged particle injection in plasma accelerators.

According to an aspect of the invention, there is provided a method of producing electromagnetic radiation, comprising:

forming a plasma channel in a capillary; firing a laser pulse through the plasma channel; arranging for a group of charged particles to be injected into a plasma density wake of the laser pulse so as to be accelerated by the wake; and arranging the plasma channel and the firing of the laser pulse such that the wake of the laser pulse exerts a transverse force on the injected group of charged particles that varies periodically as the laser pulse propagates along the channel length, the resulting transverse acceleration of the group of charged particles causing emission of said electromagnetic radiation.

According to a further aspect of the invention, there is provided an electromagnetic radiation source, comprising: a capillary suitable for creating a plasma channel; a laser source arranged to fire a laser pulse through the plasma channel; and means for injecting a group of charged particles into a plasma density wake of the laser pulse so that the group is accelerated by the wake, wherein the laser source and channel are arranged so that in use the wake of the laser pulse exerts a transverse force on the injected group of charged particles that varies periodically as the laser pulse propagates along the channel length, the resulting transverse acceleration of the bunch of charged particles causing emission of said electromagnetic radiation.

According to the above, the wake behind a laser pulse in the channel, which may be defined as the disturbance in the plasma charge density caused by passing of the laser pulse, may be used as an undulator to produce electromagnetic radiation, and in particular to produce a short high frequency radiation pulse. The spatial period between undulations (which may vary along the capillary according to the desired output frequency or range of frequencies to take into account acceleration or deceleration of the charged particles) in embodiments of such a system may be substantially shorter than 1 mm to produce X-ray radiation, in contrast to dimensions of 1 cm or longer for a comparable permanent magnet type undulator. This means, for example, that a 1000 period undulator with a periodicity of 100 microns can be made only 10 cm long, which reduces the cost and size of the undulator considerably. Conventional undulators can cost several £100 k/meter and need to be housed in large specially constructed buildings with thick layers of concrete radiation shielding. A plasma undulator such as that discussed could be added to a laser-driven accelerator (plasma accelerator) at virtually no extra cost.

The frequency of the output radiation depends on the velocity of the charged particles. The closer to the speed of light the higher the frequency. In the charged particle frame of reference the undulator period is Doppler shifted and appears to have a shorter period (by a factor equal to the relativistic Lorentz contraction factor $\gamma$). The charged particles will radiate light with this period (i.e. Doppler shifted frequency). However, from an observer in the laboratory frame the frequency is again Doppler shifted to a high frequency. It can be said that the radiation is thus double Doppler shifted—once into the charged particle frame and then again back into the laboratory frame. In practice, therefore, the frequency (and therefore wavelength) of the output radiation depends predominantly on the spatial period of the undulator ($\lambda_u$) and the energy (E) of the charged particles, which may be parameterized by the Lorentz factor $\gamma$ in $E=\gamma m_e c^2$, $m_e$ being the rest mass of the charged particle. In these terms, the output wavelength is approximately given by $\lambda=\lambda_u/2\gamma^2$. However, there are correction terms which depend on the strength of the transverse deflection force. The term "undulator" is understood in the field to encompass means to induce oscillation in one-dimension (e.g. a transverse oscillation in combination with translational motion) and also periodic motion in three-dimensions, such as helical motion in a magnetic field. For very strong deflection forces, the emitted radiation is sometimes called wiggler radiation and many high harmonics of the fundamental frequency are produced extending the spectral range of the synchrotron source.

A further useful aspect of the above embodiment is that it makes possible the production of ultra-short duration radiation pulses, potentially shorter than 10 fs, which is not easy to achieve using other tunable light sources. Moreover, this technique provides the basis for generating widely tunable femtosecond pulses of X-rays, which is difficult/impossible to do any other known way.

The short duration of the radiation pulses is possible because the plasma charge density can be made to vary on a very short length scale—typically a few tens of microns. This sets the wave period of the plasma charge density wake which the charged particles "surf down", and the surfer, which is the charged particle group or bunch being accelerated, must be shorter than the wave period otherwise it will straddle more than one plasma wave and parts of the charged particle bunch will be accelerated and parts will be decelerated. The plasma density wave period thus essentially fixes the bunch length, which in turn limits the duration of the radiation pulse.

The ability to produce femtosecond scale pulses in this way would be of value to scientists wishing to carry out time-resolved studies of the structure of matter, for example, by allowing such studies to be carried out on unprecedented time scales and providing the basis for making X-ray "movies" of the structure of matter evolving on its natural time scales, e.g. in chemical reactions etc.

The transverse force from the wake may stem from a corresponding deflection of the wake caused by deflection of the laser pulse. The plasma channel and the firing of the laser pulse can be arranged to do this in several ways. One option is to fire the laser pulse into the channel off-axis (i.e. a special arrangement of the firing of the laser pulse rather than of the channel, which can simply be straight in this embodiment), which causes a periodic transverse deflection of the laser pulse (via "mode beating"). This phenomenon can be visualized via the analogy of a toboggan or bobsleigh rattling down a snow channel or a marble rolling along a horizontal U-shaped gutter. Following the marble analogy, if the marble is rolled along the bottom of the gutter, in a direction parallel to the axis of the gutter, it will continue to roll undeflected. However, if the marble is either started to one side, or pushed in a direction which makes an angle with the axis of the gutter, or both, it will undergo periodic transverse motion (due to a gravity-induced transverse restoring force arising from the U-shape of the gutter). In a plasma channel, the transverse charge density gradient, which is what makes the plasma channel "channel" the laser pulse, provides the transverse restoring force for the laser beam.

"Off-axis" injection of the laser pulse may therefore comprise firing the laser pulse in a direction parallel to a longitudinal central axis of the channel (or capillary) but starting from a point radically spaced from the axis, or it may comprise firing the laser pulse in an oblique direction relative to the axis but starting from a point on the axis, or a mixture of both. A second option, which may be applied separately or in conjunction with the first option, is to provide a channel having a shape, induced by the shape of the capillary, that causes the periodic transverse deflection of the laser pulse and wake (i.e. a special arrangement of the channel or capillary rather than of the firing of the laser pulse, which may be carried out normally). Suitable shapes may include undulations of substantially sinusoidal longitudinal cross-section or localized deviations in cross-section that are separated longitudinally along the channel. Both options can be implemented at relatively low cost and can be used together to produce a finely controlled radiation source. Other possibilities include helix-type shapes or square-wave patterns. More generally, any shape in which there are periodic variations in the transverse position of the axis of the channel, or in the cross-section of the channel, or both, might be suitable. Further, as discussed below, it may prove useful to vary the period of the pattern with position along the channel. This may be useful, for example, for controlling the position of the accelerated charged particle bunch in the wake (for example, to keep the bunch at the same position in the wake), to vary the spectrum of the output radiation or to maintain coherence of radiation emitted from one undulator period to the next.

The above-described periodic plasma channels can be created by forming capillaries which have periodic variations in the position of their axis or in their cross-section. The capillaries can be precision machined for this purpose using laser micromachining or other etching methods in a substrate such as sapphire, for example.

The step of arranging for a group of charged particles to be injected into a wake of the laser pulse may comprise producing a group of charged particles externally of the capillary and injecting them into the capillary from the outside. This approach has the advantage that a large number of charged particles can be introduced into the channel relatively easily. Additionally or alternatively, the injected group of charged particles may originate from the plasma itself and be extracted by the wake of the laser pulse. This approach obviates the need for a separate source of charged particles and also avoids problems associated with transporting the charged particles from a separate charged particle generating system to the capillary, thereby potentially producing more controlled charged particle injection. Various methods may be used for promoting injection of charged particles from the plasma. For example, density variations in the plasma can be induced which promote charged particle injection; these can be achieved by means of deviations in the profile of the capillary (see below) and/or by using additional laser pulses (i.e. in addition to the laser pulse used to accelerate charged particles trapped in its wake).

The plasma formed in the capillary may be arranged to have a transverse density profile that favours focussing of the laser pulse towards a central axis of the capillary (i.e. the plasma forms a channel for guiding the laser pulse). This helps keep the intensity of the laser pulse high over a long distance, thus enabling more effective acceleration of charged particles in the wake of the laser pulse. The focussing effect is also what makes it possible to induce the laser pulse to undergo periodic variations: the forces which focus the laser towards the centre of the channel are the same ones that would force the laser pulse to execute periodic motion in the periodic plasma channel. The transverse density profile may, for example, be characterized by having a falling density from the walls of the channel towards the axis of the channel. Such a plasma density profile may be created where the plasma is formed by firing a discharge through a gas contained in the capillary, heat transfer to walls of the capillary causing the plasma to have a higher temperature near the central axis of the capillary compared with the temperature near the walls of the capillary.

A means for injecting a group of charged particles into the channel may be provided in the form of a longitudinally localized deviation in the cross-section of the capillary that, in use, causes a corresponding deviation in the plasma density, said deviation in the plasma density being such as to cause injection of a group of charged particles from the plasma into a wake of the laser pulse in the region of the deviation in the channel so that the group is accelerated by the wake. This arrangement allows highly controlled charged particle injection which can reduce the energy spread of an accelerated charged particle bunch as well as reduce jitter in the average energy of the charged particle bunch.

According to a further aspect of the invention, there is provided an apparatus for accelerating charged particles, comprising: a capillary suitable for forming a plasma channel; and a laser source arranged to fire a laser pulse through the plasma channel, wherein said capillary has a longitudinally localized deviation in its cross-section that, in use, causes a corresponding deviation in the plasma density, said deviation in the plasma density being such as to cause injection of a group of charged particles from the plasma into a wake of the laser pulse in the region of the deviation in the capillary so that the group is accelerated by the wake.

According to a further aspect of the invention, there is provided a method of accelerating charged particles, comprising: forming a plasma channel in a capillary; and firing a laser pulse through the plasma, wherein said capillary has a longitudinally localized deviation in its cross-section that causes a corresponding deviation in the plasma density, said deviation in the plasma density being such as to cause injection of a group of charged particles from the plasma into a wake of the laser pulse in the region of the deviation in the capillary so that the group is accelerated by the wake.

Here, charged particles are injected into the wake of the laser pulse in the sense that they are subsequently swept along by the wake, moving longitudinally away from their original positions in the plasma along the length of the channel, accelerating during this trajectory due to the electric fields within the wake so as to emerge at high energy later on in the channel (at the end of the channel, for example). These injected charged particles will stay within the wake at roughly the same distance behind the laser pulse during much of the remaining trajectory of the laser pulse in the channel. Charged particles from the plasma that are not injected into the wake may be disturbed by the laser pulse as it passes, and this may include some element of longitudinal acceleration, but such charged particles will not normally be carried along significantly with the wake: they will tend to return towards their starting positions after the laser pulse has passed. This latter case is what often happens when the laser pulse is propagating through a uniform plasma, although some injection of charged particles may nevertheless occur (for example, the wake itself will tend to act on the laser pulse even in a nominally uniform plasma, which can cause the laser pulse to distort and cause injection; furthermore, when the laser intensity is very high—high enough to cause charged particles to travel close to the speed of light—some charged particles will be spontaneously trapped in/injected into the wake). However, the dynamics of the displaced charged particles changes when the longitudinal density of the plasma is non-uniform (as may be induced by the deviations in the capillary structure, for example) and can be such as to promote the desired entrapment of the charged particles in the wake of the laser pulse.

This latter point may be understood more clearly via the surfer analogy again. Injection of charged particles into the plasma wave such that they are accelerated basically consists of preparing the charged particles to catch the wave (i.e. improving their chances of being swept along with the wave), which can be viewed as analogous to the way a surfer might paddle in the direction of an arriving wave in the sea in order to "catch" it as it passes. Just as the surfer paddles in the direction of the wave, the idea in the plasma channel is that by locally changing the form of the capillary in which the plasma channel is formed it should be possible locally to change the longitudinal density of the plasma (i.e. in the direction the wave will travel), thus causing local longitudinal gradients in the plasma density which have been shown to promote charged particle injection.

According to this approach, charged particles are injected in a controlled way into a precise part of the plasma wave, right at the point they will start to be accelerated, and acceleration can be maintained over a long distance since the laser pulse will be focussed by the channel. This approach may therefore produce a stable charged particle beam both in terms of output energy fluctuations (i.e. "jitter") and energy spread of the output charged particle bunches.

The position of the deviation in the capillary may be used to determine a final energy for the accelerated group of charged particles because it can determine the length over which the charged particles are accelerated. The output energy of the accelerator system can therefore easily be controlled by adjusting the separation between a point of injection of the charged particles to be accelerated and an output. For example, the capillary may comprise at least one further longitudinally localized deviation in its cross-section that, in use, causes at least one corresponding further deviation in the plasma density, each said further deviation in the plasma density being such as to cause injection of a further group of charged particles from the plasma into the wake of the laser pulse in the region of the further deviation in the channel so that each further group is accelerated by the wake. The plurality of localized deviations in such an arrangement can therefore be used to inject charged particles bunches that are to be accelerated to different energies, the positions of the respective longitudinal deviations determining the final energies.

Embodiments of the invention will now be described, by way of example only, with reference to the accompanying schematic drawings in which corresponding reference symbols indicate corresponding parts, and in which.

Figure 9:
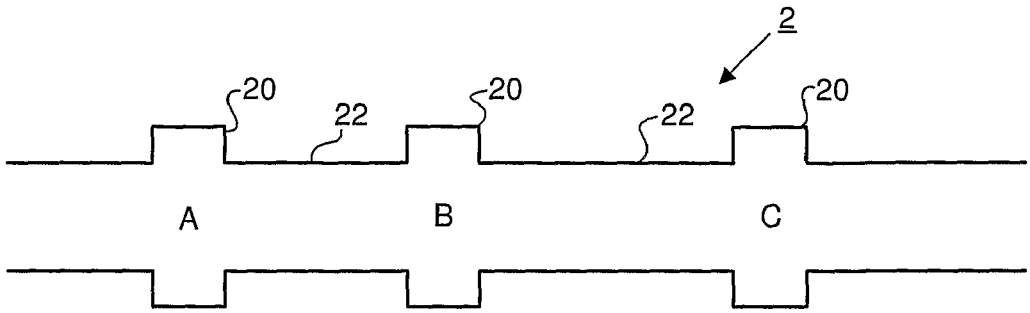
Figure 10:
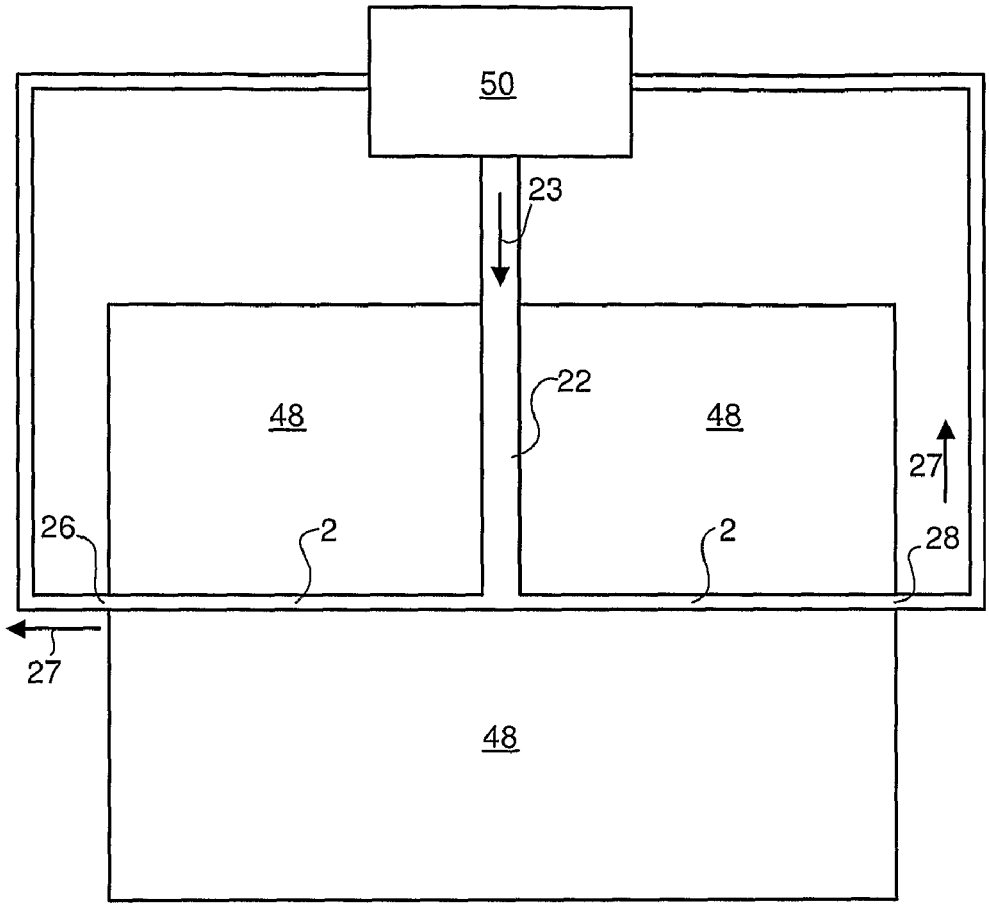

FIG. 9 illustrates a plurality of longitudinally localized deviations in the cross-section of the capillary for promoting charged particle injection from the plasma from different points; and FIG. 10 illustrates an arrangement for producing a gradually changing plasma density in the capillary A high intensity laser pulse fired through a plasma (an ionized gas) displaces charged particles as it propagates through the plasma in a similar way to a boat pushing its way through water. Like the displaced water particles in the boat analogy, the displaced charged particles also tend to return roughly (not necessarily exactly) towards their starting positions after the laser pulse has passed due to Coulomb forces, and enter into a kind of oscillatory motion in the wake of the laser pulse.

Displacement of the charged particles in the wake of the laser pulse is associated with enormous electric fields. Longitudinal components of these electric fields can be used to accelerate charged particles along the direction of the laser pulse. In particular, it is possible to inject charged particles into the wake in such a way that they effectively surf along behind the laser pulse, remaining in a region of the wake that has an accelerating longitudinal electric field component over some distance. Injecting bunches of charged particles into a wake in this way is the principle of operation of a laser-driven plasma accelerator.

A practical problem that has been encountered is maintaining the intensity of the driving laser pulse over distances of more than a millimeter or so, which has limited the output energy of laser-driven accelerators to a few hundred MeV ($10^6$ electron volts). However, recent developments have shown that a plasma waveguide can be used to keep the laser pulse focused over several centimeters, increasing the output of the accelerator to the GeV level. This is the same sort of energy routinely used in synchrotron facilities, but generated in an accelerator only a few cm long.

Figure 1A:
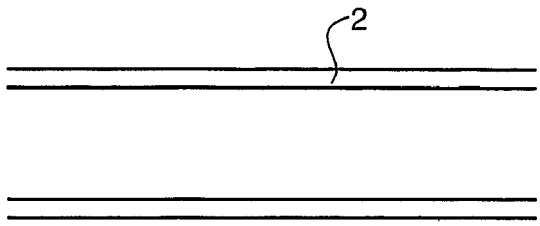
FIGS. 1A and 1B are schematic sectional and end views respectively of a capillary containing an ionized gas with a radial density gradient.
Figure 1B:
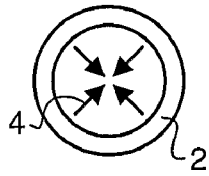

FIGS. 1A and 1B illustrate one way in which a plasma waveguide can be created according to an embodiment of the invention. A capillary 2 (shown side on in FIG. 1A and end on in FIG. 1B), which may be a few centimeters long and a few hundred micrometers in diameter, is filled with a suitable gas (hydrogen, for example). An electric discharge is then fired through the capillary 2, which ionizes the gas and produces the plasma channel. The discharge naturally produces a plasma that is hotter than the walls of the capillary and thermal conduction between the plasma and the walls causes a temperature gradient between a longitudinal axis of the capillary 2 and the walls of the capillary 2. The plasma is hotter near the axis of the capillary 2 than near the walls. The temperature gradient causes a density gradient in the plasma with the plasma having a lower density near the axis than near the walls. The effect of this density gradient is to keep the laser pulse focussed near the axis of the capillary (i.e. to "guide" the laser pulse down the plasma channel thus formed) by means of refraction (the light will tend to bend away from the higher density region towards the lower density region). Any diffractive effects tending to cause radial divergence of the laser pulse will thus tend to be compensated by the refractive properties of the plasma channel. This continual focussing of the laser pulse is indicated schematically by arrows 4 in FIG. 1B (and also FIG. 2B—see below) and is the basic principle of one type of plasma channel or waveguide.

Figure 2A:
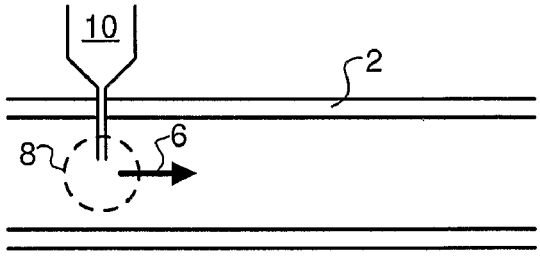
FIGS. 2A and 2B are schematic sectional and end views of the capillary of FIGS. 1A and 1B through which a laser pulse and its wake are propagating.
Figure 2B:
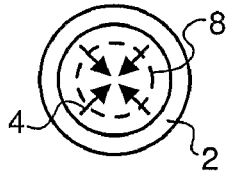

FIGS. 2A and 2B show corresponding views of the plasma-filled capillary 2 of FIGS. 1A and 1B after a laser pulse 6 has been fired down the capillary 2. Charged particles are injected from device 10 into the wake 8 of the laser pulse 6 as the laser pulse 6 passes an injection point in the capillary 2 so as to be accelerated by the wake as described above. Charged particle injection can be achieved either by injecting an externally produced charged particle beam from a conventional accelerator (as shown), or through "all-optical" injection, promoted, for example, via a density gradient induced by longitudinal structure in the capillary 2. Successfully injected charged particles are displaced by the passing laser pulse and made to oscillate at the correct phase and phase velocity to be captured by the wake and accelerated to high energies (the latter method is described in more detail below).

Accelerated bunches of charged particles can be used to produce high frequency radiation such as X-rays, which can be useful in many applications. As discussed above, this conversion process may be carried out by passing the accelerated charged particles through an undulator consisting of an array of permanent magnets configured to cause the charged particle beam to undergo periodic transverse displacements as it passes between them. However, the array of permanent magnets is expensive, inflexible and frequency-limited.

Figure 3:
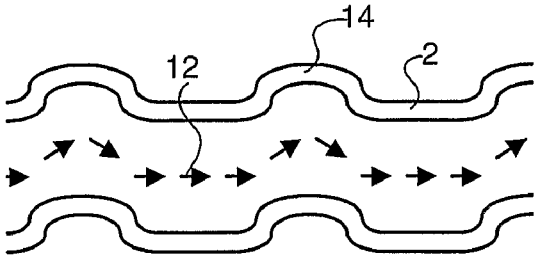
FIG. 3 illustrates a capillary shaped to operate as an undulator.
Figure 4:
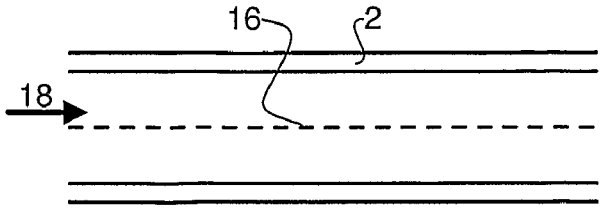
FIG. 4 illustrates off-axis firing of a laser pulse into a plasma channel to cause undulator behaviour.

FIGS. 3 and 4 show undulators according to an embodiment of the present invention, in which the wake of a laser pulse applies an undulating force on charged particles being accelerated within it. One way in which this can be achieved is by bending or otherwise forming the capillary 2 into an undulating shape as shown in FIG. 3, which causes a periodic variation in the plasma channel formed in the capillary that in turn will force the laser pulse and its wake, to undulate (i.e. be displaced periodically in a transverse direction) as it propagates through the waveguide (indicated schematically by arrows 12). The undulating plasma wake exerts a periodically changing transverse force on charged particles injected into the wake.

Various channel shapes may be used to promote the undulating motion of the wake. These may include discrete disturbances or "bumps" 14, as shown in FIG. 3, or may comprise a continuous sectional profile, for example having a substantially sinudoidal sectional form (not shown). A further alternative would be helical, which could be used to produce circularly polarized light, which would be of great advantage for some applications.

Generally speaking, the main function of the periodically varying channel is to cause the laser to follow a similar path and therefore, through the strong transverse forces of the wake, to guide the charged particle bunch also along a similar path (much in the same way as a toboggan would follow a periodically winding snow track, extending the previously used analogy)

Similar undulation of the plasma wake can be achieved by introducing the laser pulse into the waveguide channel slightly off-axis, as illustrated in FIG. 4 (arrow 18 representing a laser pulse and dotted line 16 representing a longitudinal axis of the channel 2). The effect is to produce mode beating of the laser pulse, which effectively causes the laser pulse to be periodically deflected away from the axis 16 as it propagates down the channel 2. A combination of the arrangements of FIGS. 3 and 4 may also be used to fine tune the transverse motion of the charged particle bunches.

Whichever of the two above approaches are adopted, the transverse acceleration of the charged particles in the channel 2 produces electromagnetic radiation, in the same way as a charged particle beam in an undulator insertion device in a synchrotron storage ring (which undulator would typically employ an array of permanent magnets, for example, to drive the transverse accelerations of the charged particles).

Figure 5:
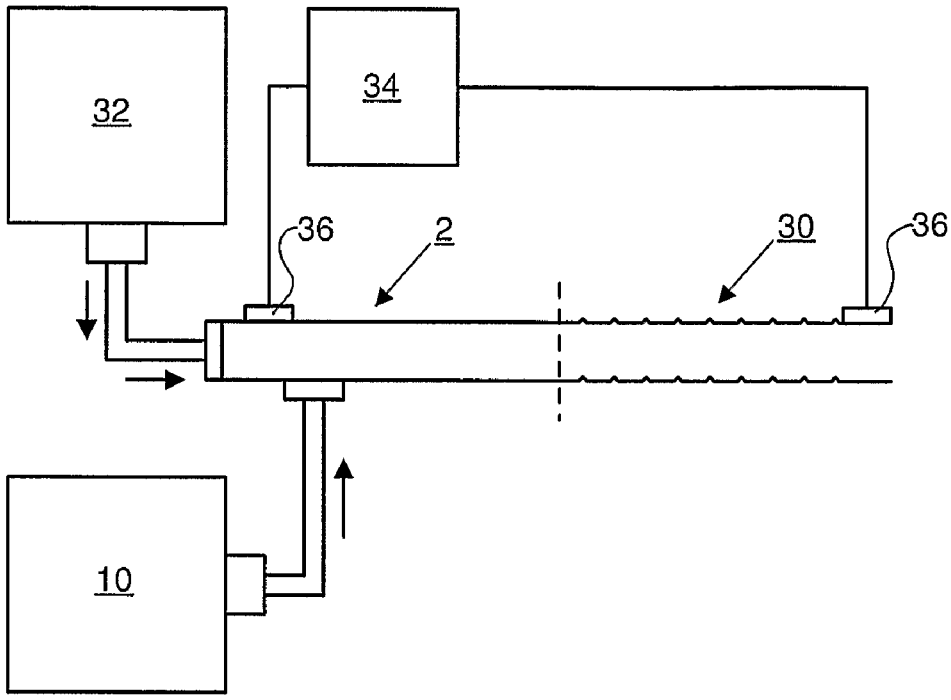
FIG. 5 illustrates a radiation source using a plasma channel undulator.

FIG. 5 shows a generalised apparatus for carrying out the above method. A capillary 2 is provided into which a gas can be introduced. A discharge circuit 34 is provided for passing an electric discharge through the gas in order to form a plasma channel within the capillary. Specific details of such an arrangement can be found in the article *Investigation of a hydrogen plasma waveguide*, D. J. Spence and S. M. Hooker, *Phys. Rev. E* 63, 015401 (R), herein incorporated in its entirety by reference.

In this example, the capillary 2 has a diameter of order 200 μm (more generally, it is envisaged that a range of capillary diameters from about 10 μm to 500 μm might be useful) and a length of several centimeters, and may comprise a hollow tube or be formed by laser-machining 'u-shaped' channels/grooves into the surface of two plates and bringing the plates together to form a capillary. Further details of how plasma channels may be created, including the method of laser machining of the capillaries and gas inlets etc. can be found in *Radiation sources based on laser-plasma interactions*, D. A. Jaroszynski, et al., *Phil. Trans. R. Soc. A*, Vol. 364, No. 1840/Mar. 15, 2006, pages—689-710-, herein incorporated in its entirety by reference. Suitable materials for the tube or plates are alumina or sapphire, or other high-temperature materials. Hydrogen gas is introduced into the capillary 2, via holes with a diameter of order 100 μm which are laser-machined near each end, so that the density of hydrogen is constant between these gas injection points. An alternative arrangement would be to inject gas at different pressures at each end of the capillary 2. This would set up a flow of gas along the capillary 2 which would give a small longitudinal gradient in the plasma density; such gradients may be useful for "phase-matching" the acceleration, although they would not be sufficient to induce charged particle injection. Electrodes 36 located at each end of the capillary enable a discharge pulse to be struck through the capillary 2 by the discharge circuit 34, thereby ionizing the gas within. The discharge pulse is driven by a capacitor with a capacitance of order 2 nF, charged to an initial voltage of around 20 kV. The resulting discharge current has a peak of several hundred amperes and a half-period of order 200 ns.

Laser source 32 is configured to introduce a laser pulse into the channel 2 (either on- or off-axis) once the plasma has been established. In practice, this can be done using a mirror or lens to focus the laser beam into the desired part of the capillary 2.

Charged particle source 10 is provided to inject the charged particles to be accelerated by the wake of the laser pulse into the capillary 2. Alternatively and/or additionally, the charged particles may be injected from the plasma itself by providing localized deviations in the cross-section of the capillary 2 (see below). An undulator section 30 may be provided at the output end of the channel 2 for applying transverse periodic motion to the charged particle beam in order to produce radiation (for example X-rays). The charged particles may continue to be accelerated as they propagate through the undulator section 30 so that the spatial separation between undulations may have to increase (taking into account relativistic effects, of course) moving from left to right along the undulator section 30 if the frequency of the radiation which is generated is to be kept constant in the laboratory frame of reference. The important point is that the double Doppler shift will change as the charged particles reach higher energy, which will tend to shift the radiation frequency upwards. This effect can be compensated by increasing the "undulator" periodicity so that the output radiation frequency remains constant.

There may also be applications where it would be useful to allow changes in the generated frequency as the charged particles propagate through the undulator. For example, this might allow broad bandwidth radiation to be generated which could subsequently be compressed to generate very short duration pulses.

Thus, manipulation of the undulator period (either with a constant or varying period) can be used to control the detailed properties of the spectrum of the output radiation.

Although the accelerating portion of the channel 2 and the undulating section 30 are shown as separate elements in the embodiment of FIG. 5, they may also be combined into a single channel.

According to an embodiment of the invention, injection of charged particles into the wake of the laser pulse is achieved by promoting acceleration of charged particles from the plasma itself. This may be achieved by creating a deviation in the cross-section of the capillary 2. The deviation in the cross-section of the capillary 2, which is localized in the sense of being of short spatial extent along a longitudinal axis of the waveguide (i.e. along the direction of propagation of the laser pulse), causes a corresponding localized deviation in the density of the plasma. This localized density deviation promotes joining of a large number of charged particles (a "bunch") into the wake of the passing laser pulse (such that they are accelerated and stay in the wake as it moves down the capillary 2) and the acceleration of charged particles thus injected can be maintained over a long distance since the laser pulse will be channelled by the plasma channel formed in capillary 2 (for example, due to the refractive effects of the temperature induced radial density gradient in the plasma). The technique allows a high level of control of properties of the output charged particle beam such as output energy fluctuations (i.e. "jitter") and energy spread of the output charged particle bunches.

The deviation in the cross-section of the capillary 2 can take a number of different forms. For example, the deviations may be localized in the sense that the length of capillary over which the cross-sectional shape of the capillary changes is small in comparison with the length of the capillary 2. The effect of this arrangement is to cause a spatially sharp or sudden change in the plasma density in the region of the deviation. The form of the capillary may be identical either side of the deviation or may be different (for example, when the deviation is a step-change in the cross-sectional area of the capillary).

Figure 6:
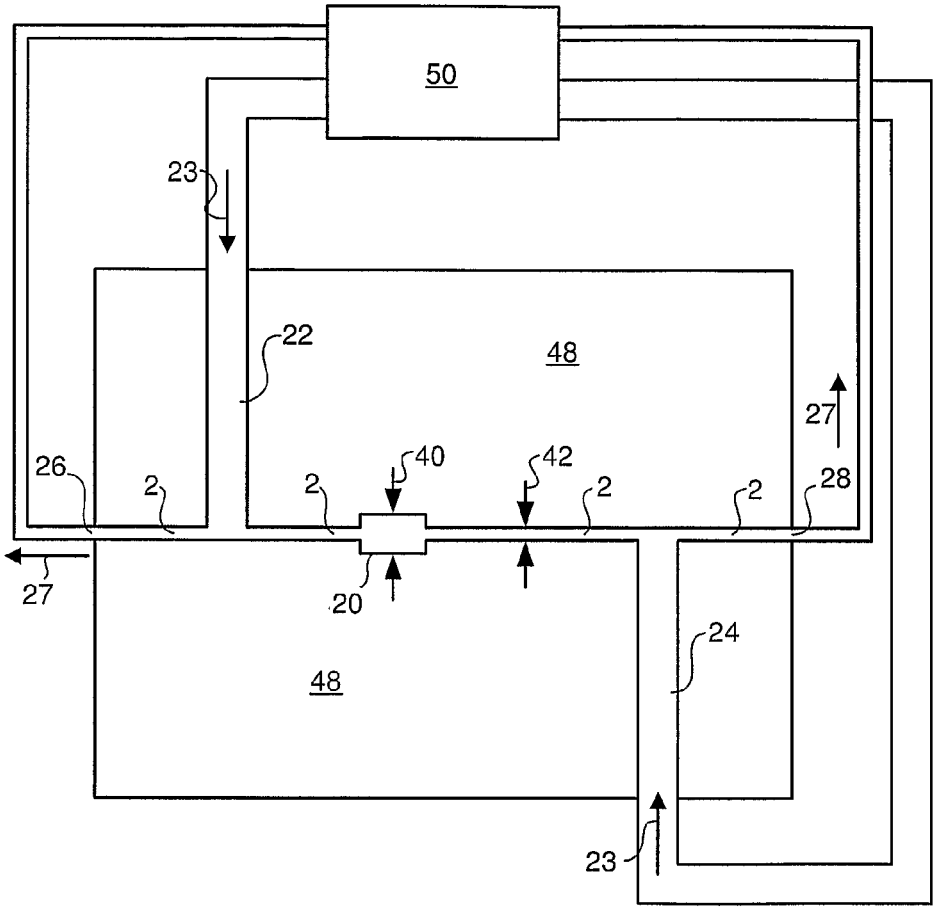
FIG. 6 illustrates a longitudinally localized deviation comprising a localized increase in the cross-sectional area of the capillary.

FIG. 6 shows an example arrangement. Gas to be ionized to produce the plasma in capillary 2 is introduced via gas inlet pipes 22 and 24 formed in substrate 48 (the direction of gas flow being indicated by arrows 23) and leaves the capillary 2 via gas outlets 26 and 28 (the direction of gas flow being indicated by arrows 27). The gas flow may be provided and controlled by means of a gas flow controller 50. The localized deviation in this example comprises a localized increase 20 in the cross-sectional area of the capillary 2. For the particular example shown, the diameter 42 of the capillary 2 is 210 microns and the diameter 40 of the localized increase 20 is 420 microns. However, the diameters and/or length of the localized deviation may be varied to achieve optimal charged particle injection. This arrangement leads to a sharp change in the longitudinal (also referred to as "axial") density of the plasma channel formed in the capillary 2 through a combination of changes in the heat flow to the wall of the capillary 2 and changes to the way the gas flows through the capillary 2 linked to the localized deviation 20.

Figure 7:
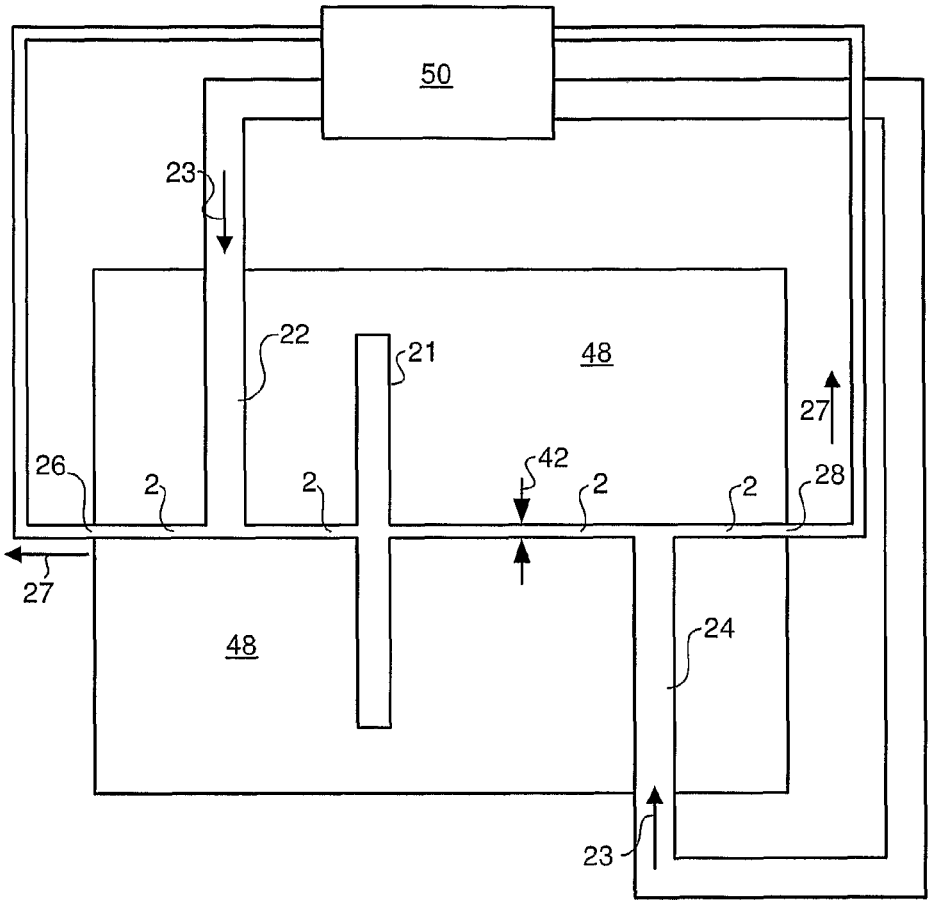
FIG. 7 illustrates a longitudinally localized deviation comprising an additional section of capillary extending laterally outwards.

FIG. 7 shows an alternative embodiment including a similar arrangement of gas inlets 22/24, outlets 26/28, gas flow 23/27 and capillary 2 as FIG. 6 (the same reference numerals have been used to represent analogous features). However, in this embodiment, the localized deviation comprises an additional section of capillary 21 extending laterally away from the capillary 2 down which the laser pulse will propagate in use. In the example shown, the additional section of capillary 21 extends away from the capillary 2 in two directions (up and down in FIG. 7), but it is also conceivable that the additional section 21 will only extend away in a single direction. When the electrical discharge is fired down the capillary 2, plasma is forced up into this additional capillary 21 which leads to the required sharp localized change in the longitudinal density of the plasma.

Figure 8:
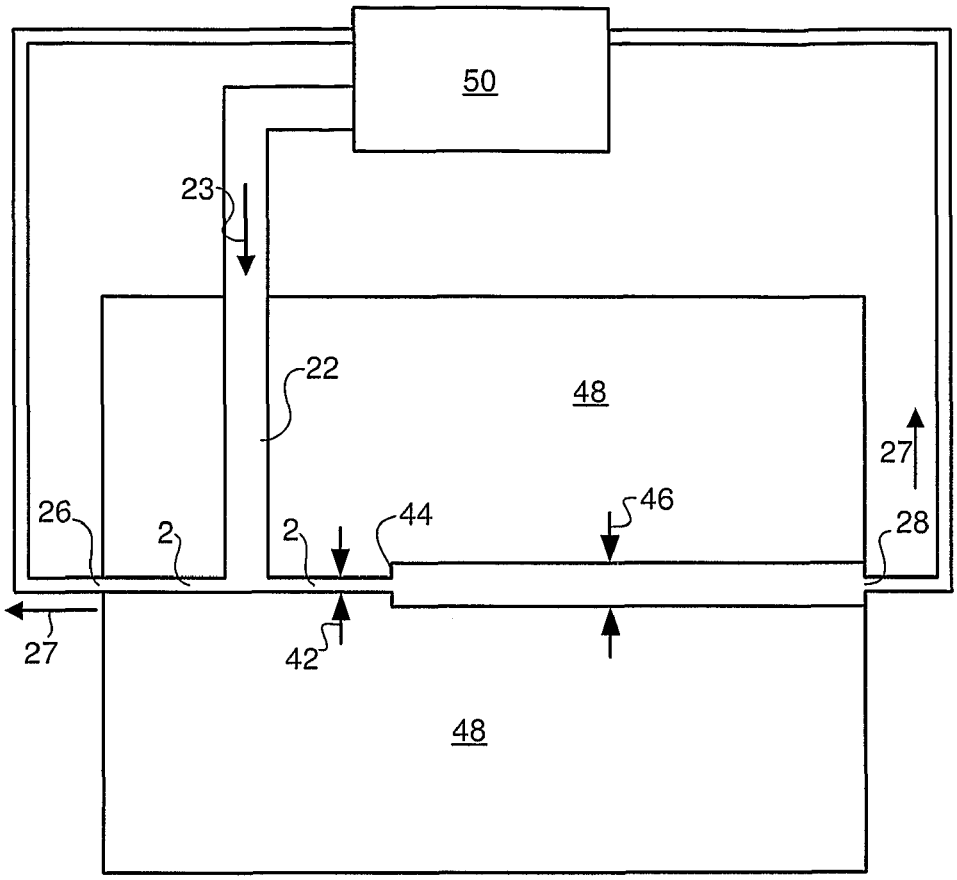
FIG. 8 illustrates a longitudinally localized deviation comprising a step-change in the cross-sectional area of the capillary, with means for producing an adapted gas flow pattern.

FIG. 8 shows a further embodiment, which makes use of a different flow pattern for the gas to be ionized. In this example, only a single gas inlet 22 is provided with two gas outlets 26 and 28 in order to produce a steady flow of gas to be ionized in the capillary 2. The localized deviation consists in this case of a step-change 44 in the cross-sectional area of the capillary 2. In effect, the capillary 2 is made up of two sections, a first with a smaller diameter 42 (of 210 microns in the particular example given) and a second with a larger diameter 46 (of 460 microns in the particular example given). Gas is made to flow continuously over the step-change 44 before the electrical discharge is fired, thereby establishing an initial gas density that varies along the axis of the capillary 2 (which is not the case in the embodiments of FIGS. 6 and 7). When the electrical discharge is fired, the variation in initial gas density translates to a corresponding variation in the longitudinal density of the plasma.

Other shapes of localized deviation may also be suitable, for example deviations with a tapered profile (i.e. comprising a continuously changing cross-section over a short (localized) length of the capillary 2), or deviations with a helically varying cross-section (or other azimuthally non-uniform deviation). Generally speaking, the deviations should be such as to perturb the plasma density in the region of the deviation in such a way as to promote the injection of charged particles into the wake of a laser pulse passing through the channel 2.

Bunches of charged particles carried along in the wake of a laser pulse in the capillary 2 are subjected to electrical forces that increase the energy of the bunch. Normally, the capillary 2 will be arranged such that bunches of charged particles are accelerated continuously from an injection point (where the charged particles are injected) to an output point (where the charged particles escape the capillary 2). The output energy of a charged particle bunch in such an arrangement will therefore depend, for a given laser pulse, on the distance between the injection and output points.

A capillary 2 can be configured to output bunches of charged particles with different output energies by controlling the point in the channel at which the charged particles are injected into the wake of the laser pulse. Charged particle bunches inserted into the wake early in its trajectory through the capillary 2 will be accelerated more than charged particles injected into the wake later on. FIG. 9 show schematically how a capillary 2 might be configured to output charged particle bunches with three different energies, corresponding to each of the three longitudinally localized deviations 20, which promote charged particle injection at each of the points A, B and C. For laser pulses travelling from left to right in the figure, charged particles injected at point A will have the highest energy, following next by charged particles injected at point B, with charged particles injected at point C having the lowest energy.

The above discussion assumes that the injected charged particles are accelerated over their entire trajectory along the capillary 2, which it is envisaged will be the normal arrangement. However, this may not always be the case, depending on how far the charged particles are made to travel down the capillary 2. If no countermeasures are taken, for example, the accelerated charged particles (which quickly reach speeds near to the speed of light in vacuum) will eventually overtake the laser pulse which is propagating at a slower speed through the plasma (or at least advance relative to the laser pulse to a point in the wake which is no longer in an accelerating electric field), a phenomenon known as "dephasing" that will interrupt acceleration of the charged particle bunch.

As mentioned above, the problem of de-phasing may be tackled by establishing a plasma density in the capillary that changes gradually in the longitudinal direction (as opposed to the sharp localized change that is needed for injection of charged particles into the wake of the laser pulse). Such a gradual change may take place over a significant portion of the trajectory of the laser pulse, for example, which will generally mean over a distance considerably (i.e. many times) longer than the spatial period of undulations in a capillary radiation source or the longitudinal extent of the localized deviations in an injector. FIG. 10 shows an example of how this might be achieved over section of uniform capillary 2, with gas being input via inlet 22 and output via outlets 26 and 28. In the arrangement shown, the density of gas before the electrical discharge is fired may be estimated theoretically. In particular, for the majority of the capillary 2, assuming the flow is viscous, laminar and incompressible, the pressure variation within the capillary may be written as:

$$P(z) = P(z_g)\sqrt{\frac{z}{z_g}}$$

where z is the distance from the gas outlet 26 or 28 and $z_g$ is the distance from the gas inlet 22 to the gas outlet 26 or 28. $P(z_g)$ is the initial pressure at the gas inlet 22. This arrangement therefore produces a gas density that changes gradually over an extended region of the capillary 2 which, when the electrical discharge is fired, with produce a plasma channel with a plasma density that also varies gradually along the length of the capillary 2.

In the example shown in FIG. 10, the gas inlet 22 is located in the centre of the capillary 2 but other arrangements are possible that will still permit a gradually changing plasma density to be formed. A further possible variation would be to add further gas inlets along the length of the capillary 2, which would make it possible to control the longitudinal profile of the initial gas density, and hence the longitudinal plasma density once the discharge has fired, more precisely.

Both gradually increasing plasma densities (i.e. increasing along the direction of propagation of the laser pulse) and gradually decreasing plasma densities may be useful for improving the performance of laser-driven plasma accelerators. For example, gradually increasing plasma densities would generally be effective for overcoming dephasing, while gradually decreasing plasma densities would generally be effective for reducing the energy spread of a bunch of accelerated charged particles.

In the above examples, the charged particles in question will usually be electrons and/or positrons, but other charged particles may also be used.

The invention claimed is:

1. A method of producing electromagnetic radiation, comprising:

forming a plasma channel in a capillary;

firing a laser pulse through the plasma channel;

arranging for a group of charged particles to be injected into a plasma density wake of the laser pulse so as to be accelerated by the wake; and arranging the plasma channel and the firing of the laser pulse such that the wake of the laser pulse exerts a transverse force on the injected group of charged particles that varies periodically as the laser pulse propagates along the channel length, the resulting transverse acceleration of the group of charged particles causing emission of said electromagnetic radiation.

2. (A method according to claim 1, wherein the laser pulse is fired into the plasma channel off-axis so as effectively to cause a periodic transverse deflection of the laser pulse and its wake as the laser pulse propagates along the channel length.

3. A method according to claim 2, wherein the laser pulse is fired into the plasma channel at a position radically separated from a longitudinal central axis of the channel, at an oblique angle to the longitudinal central axis of the channel, or a combination thereof.

4. A method according to claim 1, wherein the plasma channel has a shape, induced by the shape of the capillary, that causes a periodic transverse deflection of the laser pulse and its wake as the laser pulse propagates along the channel length.

5. A method according to claim 4, wherein the shape of the capillary comprises at least one of the following: undulations of substantially sinusoidal longitudinal cross-section, localized deviations in cross-section separated longitudinally, helical deviations in cross-section, and undulations of square-wave longitudinal cross-section.

6. A method according to claim 5, wherein a spatial periodicity in the shape of the capillary varies longitudinally such as to achieve a substantially constant frequency of transverse deflection.

7. A method according to claim 5, wherein a spatial periodicity in the shape of the capillary varies longitudinally such as to achieve a frequency of transverse deflection that substantially varies as the laser pulse propagates down the plasma channel.

8. A method according to claim 1, wherein the step of arranging for a group of charged particles to be injected into a wake of the laser pulse comprises producing a group of charged particles externally of the channel and injecting them into the channel.

9. A method according to claim 1, wherein the step of arranging for a group of charged particles to be injected into a wake of the laser pulse comprises promoting extraction of a group of charged particles from the plasma by the wake of the laser pulse.

10. An electromagnetic radiation source, comprising:

a capillary suitable for creating a plasma channel;

a laser source arranged to fire a laser pulse through the plasma channel; and means for injecting a group of charged particles into a plasma density wake of the laser pulse so that the group is accelerated by the wake, wherein the laser source and channel are arranged so that in use the wake of the laser pulse exerts a transverse force on the injected group of charged particles that varies periodically as the laser pulse propagates along the channel length, the resulting transverse acceleration of the group of charged particles causing emission of said electromagnetic radiation.

11. An electromagnetic radiation source according to claim 10, wherein:

said means for injecting a group of charged particles comprises a longitudinally localized deviation in the cross-section of the capillary that, in use, causes a corresponding deviation in the plasma density, said deviation in the plasma density being such as to cause injection of a group of charged particles from the plasma into a wake of the laser pulse in the region of the deviation in the capillary so that the group is accelerated by the wake.

12. An apparatus for accelerating charged particles, comprising:

a capillary suitable for forming a plasma channel; and a laser source arranged to fire a laser pulse through the plasma channel, wherein said capillary has a longitudinally localized deviation in its cross-section that, in use, causes a corresponding deviation in the plasma density, said deviation in the plasma density being such as to cause injection of a group of charged particles from the plasma into a wake of the laser pulse in the region of the deviation in the capillary so that the group is accelerated by the wake.

13. An apparatus according to claim 11, wherein said longitudinally localized deviation comprises one of one of the following:

a localized change in the cross-sectional area of the capillary;

localized increase in the cross-sectional area;

an additional section of capillary opening out into, and extending laterally away from, the capillary down which the laser pulse will propagate.

14. An apparatus according to claim 11, further comprising:

a gas flow controller arranged to establish a gas flow along said capillary; and a discharge circuit for passing an electric discharge through the gas flow in order to form a plasma channel within the capillary, wherein said localized deviation comprises a step change in the capillary diameter.

15. An apparatus according to claim 11, wherein a position of said deviation in the capillary determines a final energy for the accelerated group of charged particles.

16. An apparatus according to claim 11, wherein said capillary comprises at least one further longitudinally localized deviation in its cross-section that, in use, causes at least one corresponding further deviation in the plasma density, each said further deviation in the plasma density being such as to cause injection of a further group of charged particles from the plasma into the wake of the laser pulse in the region of the further deviation in the capillary so that each further group is accelerated by the wake.

17. An apparatus according to claim 16, wherein groups of charged particles injected at different deviations in the capillary are accelerated to different final energies, the positions of the respective longitudinal deviations determining said final energies.

18. An apparatus according to claim 11, wherein said deviation(s) comprise(s) at least one of the following: a helical cross-sectional deviation, and a tapered cross-sectional deviation.

19. An apparatus according to claim 10, wherein said capillary is arranged so that in use the density of the plasma at a given time gradually increases or gradually decreases as a function of position along an extended longitudinal portion of the capillary.

20. An apparatus according to claim 11, wherein said capillary is arranged to that in use the density of the plasma at a given time gradually increases or gradually decreases as a function of position along an extended longitudinal portion of the capillary.

* * * * *